US008522489B2

(12) United States Patent
Bear

(10) Patent No.: US 8,522,489 B2
(45) **Date of Patent: *Sep. 3, 2013**

(54) COMPONENT FOR BUILDINGS

(75) Inventor: Kurtis Bear, La Crescent, MN (US)

(73) Assignee: SDK, LLC, La Crosse, WI (US)

( * ) Notice: Subject to any disclaimer, the term of this patent is extended or adjusted under 35 U.S.C. 154(b) by 49 days.

This patent is subject to a terminal disclaimer.

(21) Appl. No.: 12/435,923

(22) Filed: May 5, 2009

(65) Prior Publication Data

US 2010/0236181 A1 Sep. 23, 2010

Related U.S. Application Data

(60) Provisional application No. 61/161,392, filed on Mar. 18, 2009.

(51) Int. Cl.
*E04F 10/00* (2006.01)

(52) U.S. Cl.
USPC ..... 52/173.1; 52/506.4; 52/648.1; 52/507; 52/674; 52/745.06; 52/202

(58) Field of Classification Search
USPC ..... 52/202, 203, 783.11, 783.12, 783.14, 52/783.15, 784.1, 579, 746.1, 749.1, 173.1, 52/648.1, 506.04, 745.06, 473, 653.1, 633, 52/637, 660, 674, 747.1, 746.11; 49/57, 49/61–62, 464; D26/121
See application file for complete search history.

(56) References Cited

U.S. PATENT DOCUMENTS

| | | | | |
|---|---|---|---|---|
| D27,973 | S | 12/1897 | Belcher | |
| D54,925 | S | 4/1920 | Johanson | |
| D90,096 | S | 6/1933 | Beam | |
| 1,972,563 | A * | 9/1934 | Irvin | 181/292 |
| 2,388,927 | A | 11/1945 | Moor, Jr. | |
| 2,492,909 | A * | 12/1949 | Warp | 428/132 |
| 2,597,633 | A | 5/1952 | Graham | |
| 2,668,484 | A | 2/1954 | Bustin | |
| 2,668,729 | A | 2/1954 | Bustin | |
| D173,156 | S | 10/1954 | Hurley | |
| D173,157 | S | 10/1954 | Hurley | |
| 2,708,775 | A | 5/1955 | Maas | 52/78 |
| D177,149 | S | 3/1956 | Prince | |
| 2,755,523 | A | 7/1956 | Gralinski | 52/78 |

(Continued)

FOREIGN PATENT DOCUMENTS

WO 8607164 12/1986

OTHER PUBLICATIONS

KAWNEER, an Alcoa Company brochure for 1600 SunShade™ 2007 (2 pgs).

(Continued)

*Primary Examiner* — Jeanette E. Chapman
(74) *Attorney, Agent, or Firm* — Billion & Armitage; Benjamin C. Armitage

(57) ABSTRACT

A panel and panel systems are described herein and can include a rigid panel that includes a plurality of apertures and an undulating pattern. The panel acts to block sunlight and may otherwise protect the area behind the panel. In an example, the panel is fixed in a spaced apart relation to a building. The panel or panels block a portion of the direct sunlight to assist in the environmental control of the building. The panel can be strong enough to further protect the building from weather damage or other damage.

30 Claims, 5 Drawing Sheets

(56) References Cited

U.S. PATENT DOCUMENTS

| | | | | | |
|---|---|---|---|---|---|
| 2,805,810 | A | | 9/1957 | Butz | |
| 2,827,169 | A | * | 3/1958 | Cusi | 209/397 |
| 2,925,650 | A | * | 2/1960 | Pall | 29/896.62 |
| 2,984,152 | A | * | 5/1961 | Mihalakis | 359/459 |
| 2,988,980 | A | | 6/1961 | Tschudin | |
| 2,990,923 | A | * | 7/1961 | Macias-Sarria | 52/473 |
| 3,004,642 | A | | 10/1961 | Hallock | |
| 3,072,230 | A | * | 1/1963 | Gelert | 52/473 |
| D195,942 | S | | 8/1963 | Zola | |
| 3,113,434 | A | * | 12/1963 | Phillips et al. | 52/11 |
| 3,129,895 | A | | 4/1964 | Franck | |
| D200,312 | S | | 2/1965 | Monroe | |
| 3,197,820 | A | * | 8/1965 | Claire, Sr. et al. | 52/660 |
| 3,204,324 | A | | 9/1965 | Nilsen | |
| 3,213,274 | A | | 10/1965 | Stiffel | |
| 3,254,968 | A | * | 6/1966 | Bender | 428/596 |
| 3,260,026 | A | * | 7/1966 | Bacon | 52/473 |
| 3,289,376 | A | * | 12/1966 | Brown | 52/799.12 |
| D208,367 | S | | 8/1967 | Blitzer | |
| 3,367,077 | A | | 2/1968 | Johnston | |
| 3,729,874 | A | | 5/1973 | Albany | |
| D228,518 | S | | 10/1973 | Nishimura et al. | |
| 3,823,524 | A | | 7/1974 | Weinstein | |
| D233,687 | S | | 11/1974 | Deaton | |
| 3,858,803 | A | * | 1/1975 | Gantert | 238/14 |
| 3,956,863 | A | | 5/1976 | Tiedeken | |
| D246,741 | S | | 12/1977 | Korn | |
| 4,211,504 | A | * | 7/1980 | Sivachenko | 405/284 |
| 4,217,742 | A | | 8/1980 | Evans | 52/995 |
| 4,231,207 | A | | 11/1980 | Kern et al. | |
| 4,393,629 | A | | 7/1983 | Gasparini et al. | 52/74 |
| 4,418,506 | A | | 12/1983 | Weber et al. | |
| 4,463,540 | A | | 8/1984 | Gordon | |
| 4,637,444 | A | * | 1/1987 | Tanner | 160/91 |
| 4,650,702 | A | | 3/1987 | Whitmyer | |
| 4,680,905 | A | | 7/1987 | Rockar | |
| D294,819 | S | | 3/1988 | Kuri | |
| 4,730,424 | A | | 3/1988 | Green et al. | 52/180 |
| 4,734,337 | A | * | 3/1988 | Patton | 428/595 |
| 4,859,901 | A | | 8/1989 | Thompson-Russell | |
| 4,938,445 | A | | 7/1990 | Medley | |
| 4,967,509 | A | | 11/1990 | Storey et al. | 49/74 |
| D327,543 | S | | 6/1992 | Gardner | |
| 5,158,348 | A | | 10/1992 | Sakamoto et al. | |
| 5,221,363 | A | | 6/1993 | Gillard | 136/248 |
| 5,299,395 | A | | 4/1994 | Smith et al. | |
| 5,355,645 | A | | 10/1994 | Farag | |
| D369,998 | S | | 5/1996 | Eskandry | |
| D371,447 | S | | 7/1996 | Williams | |
| 5,594,628 | A | | 1/1997 | Reuter et al. | |
| 5,996,292 | A | * | 12/1999 | Hill et al. | 52/202 |
| 6,171,015 | B1 | | 1/2001 | Barth et al. | |
| 6,421,966 | B1 | | 7/2002 | Braunstein et al. | |
| 6,424,096 | B1 | | 7/2002 | Lowe et al. | |
| D464,737 | S | | 10/2002 | Gulbrandsen et al. | |
| 6,514,589 | B1 | * | 2/2003 | Chang et al. | 428/41.7 |
| 6,517,216 | B1 | | 2/2003 | Cercone et al. | |
| 6,550,196 | B2 | | 4/2003 | Braybrook | |
| 6,608,453 | B2 | | 8/2003 | Morgan et al. | |
| D489,140 | S | | 4/2004 | Froech | |
| D489,141 | S | | 4/2004 | Froech | |
| 6,761,470 | B2 | | 7/2004 | Sid | |
| 6,834,467 | B2 | | 12/2004 | Gulbrandsen et al. | |
| 6,846,092 | B2 | | 1/2005 | Taylor et al. | |
| D502,284 | S | | 2/2005 | Egawa et al. | |
| 6,918,680 | B2 | | 7/2005 | Seeberger | |
| 6,945,675 | B2 | | 9/2005 | Jongewaard et al. | |
| 6,968,660 | B1 | | 11/2005 | Novoa | 52/473 |
| 7,134,254 | B1 | | 11/2006 | Van Gelder | |
| D537,957 | S | | 3/2007 | Pilby | |
| 7,348,949 | B2 | | 3/2008 | Lee | |
| 7,401,939 | B2 | | 7/2008 | Haugaard et al. | |
| 7,591,566 | B2 | | 9/2009 | Galke et al. | |
| 2003/0227772 | A1 | | 12/2003 | Yoshida et al. | |
| 2004/0012957 | A1 | | 1/2004 | Bachl et al. | |
| 2005/0284053 | A1 | | 12/2005 | Grunewald et al. | |
| 2007/0220824 | A1 | * | 9/2007 | Hasegawa et al. | 52/506.05 |
| 2008/0073036 | A1 | | 3/2008 | Braunstein et al. | |
| 2008/0098665 | A1 | | 5/2008 | DeYoung | |
| 2010/0262293 | A1 | * | 10/2010 | Byberg et al. | 700/275 |

OTHER PUBLICATIONS

KAWNEER, an Alcoa Company features brochure for 1600 SunShade™ Dec. 2006 (8 pgs).

Ametco Manufacturing Corp SunShades brochure 2009 www.ametco.com (4 pgs).

Ametco Manufacturing Corp Perforated Metal & Plastics brochure (8 pgs).

WAUSAU Window and Wall Systems Architectural Products—Window: Sun Control. 2004 (19 pgs).

WAUSAU Window and Wall systems Curtainwall, Elevation: Superwall Series, 2004 (35 pgs).

Projects, http://www.americanmetalcraft.com/Projects.html Jan. 23 American Metalcraft Inc., 2009. (2 pgs).

H & H Enterprises, Inc. Architectural Metals, Aluminum Sun Shades brochure, http://www.h-hmetals.com (2 pgs).

By Justin, MetaEfficient Reviews, "Solar Building Automatically Shades Itself From the Sun", http://metaefficient.com/architecture-and-building/solar-building-automatically-shades-itself-from-the-sun.html Apr. 24, 2007. (4 pgs).

WAUSAU Window and Wall Systems Technical Guide for7250-UW Series Unitized Curtain Wall (13 pgs).

* cited by examiner

COMPONENT FOR BUILDINGS

FIELD OF THE INVENTION

The present description is directed to a component for building, and more specifically, to an exterior panel for a building.

BACKGROUND

Commercial buildings such as office buildings or apartments are expensive to build, maintain, and repair. The exterior of buildings can be damaged by weather or people. Other costs associated with buildings include temperature control.

SUMMARY

An aspect of the present disclosure is a building component that protects an adjacent location, such as a building, from sunlight or other hazards. The component can be a panel that includes a body having a height and a width, a plurality of apertures in the body, and a series of undulations in the body, at least one of the undulations including a peak extending in a width direction. In an example, each of the undulations includes a peak extending in the width dimension and the undulations creating a repeating peak and valley pattern in the vertical direction. In an example, the plurality of apertures are parallelograms that include a corner at a respective one of the peaks of the undulations. In a further example, the plurality of apertures include a corner at respective valley of the undulation. In a further example, the plurality of apertures define an open area in the body in the range of about 40% to about 70%. In an example, the series of undulations include at least ten undulations in a height direction. In an example, the series of undulations form an angle from a peak to a valley up to an adjacent peak in a range of about 150 degrees to 170 degrees. In an example, the series of undulations form an angle from a peak to a valley up to an adjacent peak of about 160 degrees. In an example, the body includes a solid outer perimeter free of apertures. In an example, the body has a parallelogram shape and connection points at at least one of the corners.

In a further aspect of the present disclosure, any of the above examples can be part of a building system or a building that include a wall, an exterior connection system fixed to the wall, and a panel system connected to the exterior connection system. The panel may include any of the above examples or other details recited herein.

BRIEF DESCRIPTION OF DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
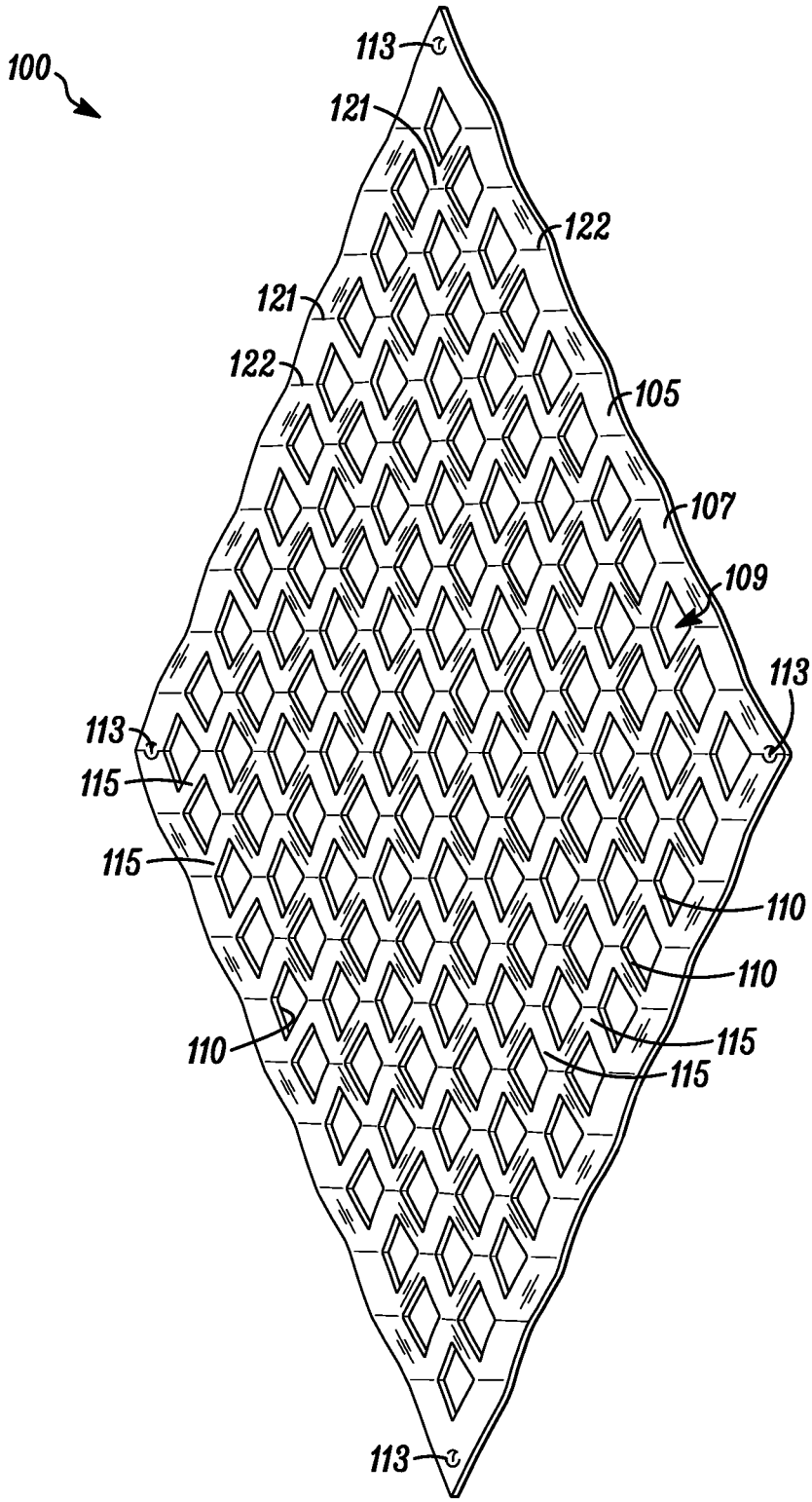
FIG. 1 is a perspective view of a panel according to an example of the present invention.

FIG. 1 shows a panel 100 for use in construction of buildings. The panel 100 can also be adapted to be used as a protective device for the exterior of a building. Panel 100 has a solid, continuous body 105. The body 105 made of a metal in an example. In an example, the body 105 has a thickness of less than ½ inch. In a further example, the body 105 has a thickness of about ¼ inch. In a further example, the body 105 has a thickness in the range of about ⅜ inch to about ⅛ inch, plus or minus 1/16 inch. The body 105 has a parallelogram shape with a first dimension and a second dimension. In an example, the first dimension is in the range of about 10 feet to 15 feet and the second dimension is about 6 feet to about 8 feet. In the embodiment, shown in FIG. 1, the panel body has a rhombus or diamond shape with the first dimension being the height and the second dimension being the width. In a specific example, the panel is about 12¼ feet in height and about 7 and ¼ feet in width. In an example, the body has a thickness of greater than 3/16 inch. In a specific example, the body has a thickness of ¼ inch.

The body 105 is defined by a continuous peripheral band 107 and an interior portion 109. The band 107 is a continuous strip of material, such as a metal. The band has a width of about 4 inches in an example. The width of the band 107 can be in a range of about 1 inch to about 6 inches. At various locations in the band 107, attachment points 113 are provided. These attachment points 113 can be through holes for receiving fasteners, such as bolts, screws, and rivets. In other examples, the attachment points 113 are adapted to receive other fasteners types, such as clamps, adhesives, etc.

The interior portion 109 includes a plurality of apertures 110 extending through the body 105. The plurality of apertures 109 are aligned in rows and columns. In an example, the number of rows equals the number of columns. In the FIG. 1 illustrated example, there are eleven rows and columns. The number of rows and columns of apertures may depend on the desired amount of light to be blocked by the panel. However, in other example, there may be a non-equal number of rows and columns. The interior body portion 109 includes resembles a web of connecting strips 115 with some strips extending in a first direction and other strips extending in a second direction. In the illustrated example, the strips in the first direction extend in the same direction as the height of the panel. The strips in the second direction extend in the same direction as the width of the panel. Accordingly, when in a plan view, the first direction strips and the second direction strips are perpendicular to each other. In other examples, the various strips need not be perpendicular to each other but can be at various angles, e.g., greater than 45 degrees and less than 90 degrees. The strips 115 have the same thickness as the band 107.

The panel 100 further includes an undulating pattern in the body 105. The undulation pattern creates peaks 121 and valleys 122 in the body 105. At least one peak is aligned at one of the corners of the apertures 110 or at the intersection of the strips 115. The peaks 121 and valleys 122 alternate in an example. The peaks 121 and valleys 122 alternate along the entire height of the panel 100. The apertures 110 extend on two adjacent webs such that the aperture extends onto both an upslope and a downslope of a peak.

Figure 2:
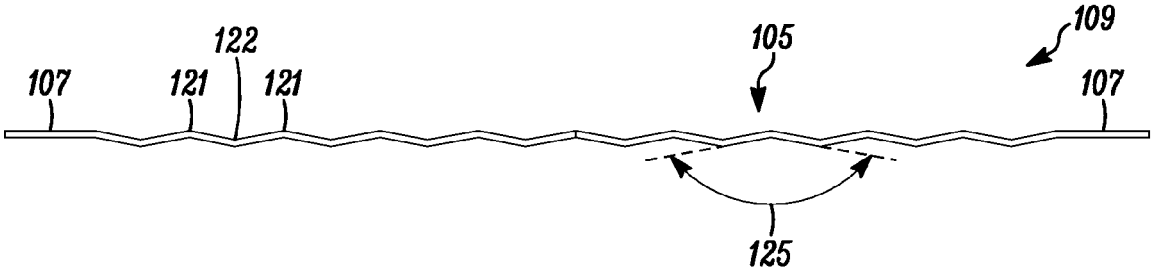
FIG. 2 is a side view of a panel according to an example of the present invention.
Figure 3:
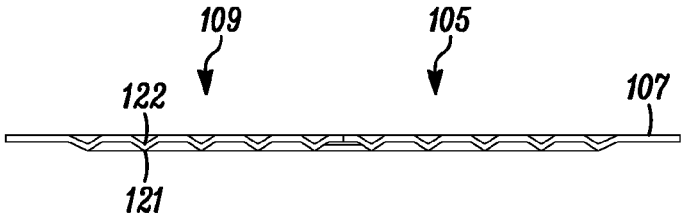
FIG. 3 is a top view of a panel according to an example of the present invention.

FIG. 2 shows a side view of the undulating pattern of the panel 100. FIG. 3 shows a top end view of the undulating pattern of the panel 100. In these views it is shown that the peaks 121 and valleys 122 extend through the band 107 to the edge of the panel body 105. An angle 125 is formed from an adjacent peak 121 to adjacent peak 121 with a valley 122 forming the vertex. It will further be recognized from FIG. 2 that a peak 121 on one face of the panel body 105 is a valley on the other face. The angle 125 is in the range of about 175 degrees to about 145 degrees. In an example, the angle 125 is in the range of about 170 degrees to about 150 degrees. The angle 125 is in the range of about 165 degrees to about 155 degrees. In an example, the angle 125 is about 160 degrees. The term about in the present paragraph refers to at least +/−one degree or at least +/−0.5 degree. Moreover, there are a plurality of peaks 121 in the panel body 105, e.g., at least 3, at least 5, at least 8, or 10 or more peaks in a panel body. In an example, there are six peaks in the panel body 105. As a peak 121 on one face is a valley on the other face, there are an equal number of peaks and valleys from face to face.

The panel 100 for ease of construction, durability, and strength is free from glass or polymers in the apertures and in the remaining body 105. The apertures are therefore through holes that allow light to pass through the panel 100. However, the interior web of the panel body 105 and the peripheral band 107 block some of the light and reflect it away from the back side of the panel. When the panel 100 is mounted in front of a building wall only a portion of the available sunlight directly impinges on the building itself. In an example, the apertures 110 create a panel 100 that has an open area of about 43%. In an example, the open area of a panel is in the range of about 40-70%. In an example, the open area of a panel is in the range of about 45-60%. The amount of panel open area depends on the application of the panel. For example, in a warm climate, e.g. Saudi Arabia, where it is desirable to keep buildings cooler during the daylight, a lower open area may be used to block more sunlight from impinging on a building. Examples of such an open area are 45% or less. In other applications of the present panel 100, it may be desirable to have more open area as the panel is adapted to protect the building from catastrophic events, such as severe weather, e.g., hurricane, typhoon, tornado, tsunami, etc. or human caused damage, e.g., riot, military action, etc. These applications may have an open area of 70% or less. In cooler climates, i.e., 45 degrees or greater north or south of the equator, there is a tradeoff in the amount of sunlight that is designed in the summer versus the winter. The undulations may assist in allowing sunlight from a lower elevations (winter sunlight), into the building while blocking light at higher elevations (summer sunlight). The webs in the panel 100 act to cover a portion of the aperture at higher inclinations and thus may block greater sublight in summer than in winter.

To fabricate the panel 100, a continuous sheet of material, such as a metal as described herein, is cut into individual panels 100. The apertures 110 are cut or punched into the interior body portion 109. The outside edge is left whole to form the band 105. If needed, the attachment points are also punched or cut in the area of the band 105. Various methods of cutting can be used, such as water jet, plasma, laser, etc. Thereafter, the panel 100 is placed in a press to form the undulation pattern, e.g., the peaks and valleys, in the entire body 105, i.e., the band 105 and interior body portion 109. In another embodiment, the panel 100 is roll formed after the apertures 110 are punched to form the undulation pattern.

Figure 4:
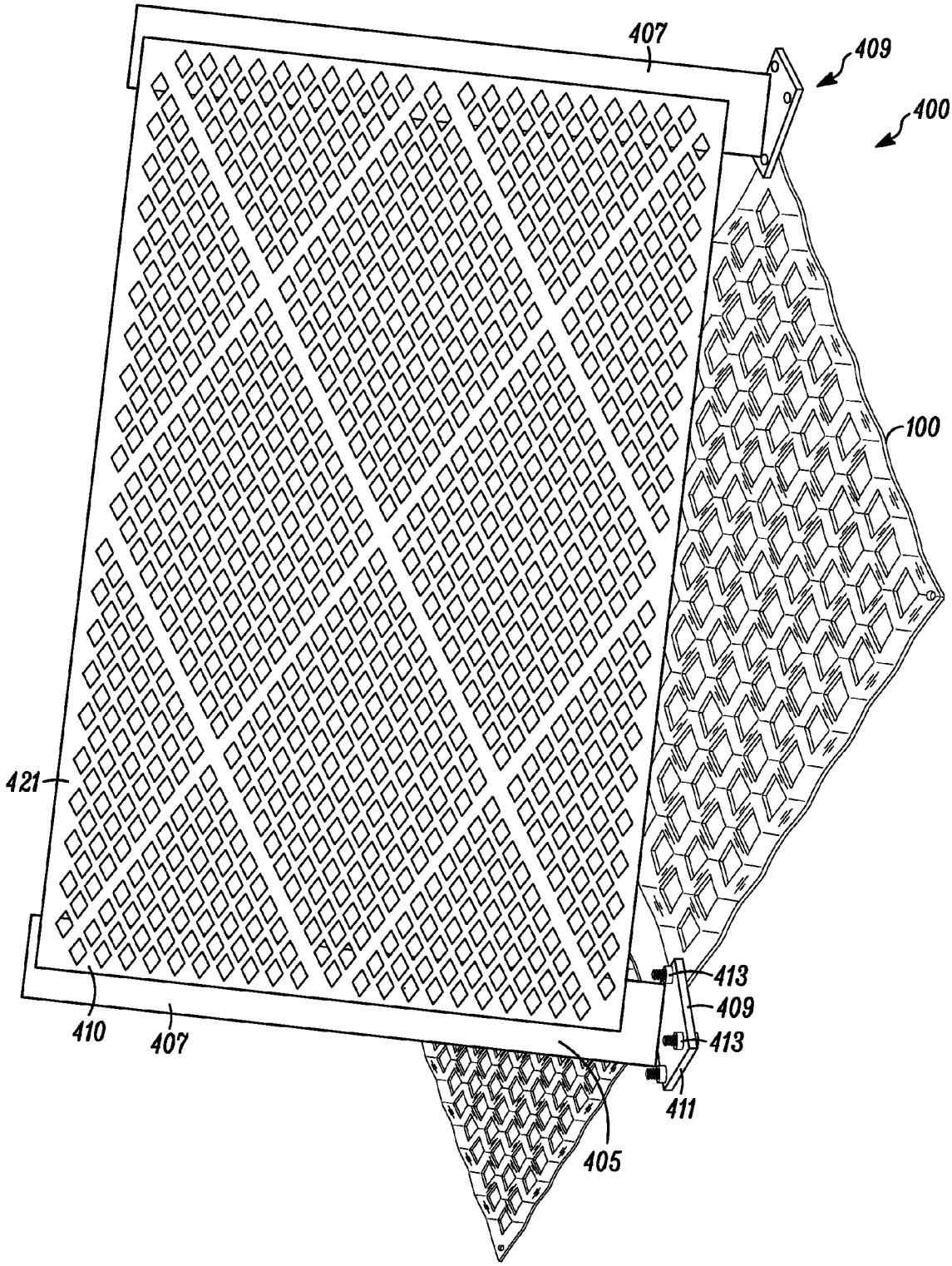
FIG. 4 is top view of a system according to an example of the present invention.

FIG. 4 shows a top view of a panel system 400 that includes a panel 100, a support system 405, and a walkway 410. The panel system 400 is adapted to be attached to a building with the panel 100 being spaced from the building. The support system 405 includes an elongate brace 407 that has a first end fixed to a building (not shown in FIG. 4) and a second end that supports a fastener assembly 409. Fastener assembly 409 is to fix to a connection point of the panel 100. In the illustrated example, the fastener assembly includes a plate 411 to which is fixed a plurality of fasteners 413. In an example, the fastener assembly 409 is in the shape of a plus sign (+) with a connection point at the distal end of at least two and, preferably each cantilevered arm. The plus sign design includes a central body that provides a connection to a support and the arms that extend therefrom to provide the connection points to the panel. Each arm can connect to one panel. At least fastener 413 is fixed to a connection point on the panel 100. The fastener 413 can be a bolt, screw, or rivet. The fastener 413 has a portion engaging the panel that cannot be released from the outside of the panel 100 remote from the support system. The panel 100, as shown, has a parallelogram shape, here a rhombus, with connection points at each vertex. One connection point is connected to a respective plate 411 with four different panels 100 connected to each plate. Thus, a plate 100 with four vertices is fixed to the support system 405 at four connection points.

The walkway 410 includes one deck section 421 extending between and fixed to two adjacent braces 407. An end of the deck section 421 extends onto half or less of the top surface of the brace 407 to allow adjacent deck sections to be fixed to the same brace 407. The deck section 421 has a web interior with apertures therethrough to allow moisture, air, and light to pass through the deck section. Various patterns can be used for the web interior of the deck section. Any pattern with apertures therein to allow moisture to travel through the deck section 421 can be used. In another example, a solid deck section is used.

Figure 5:
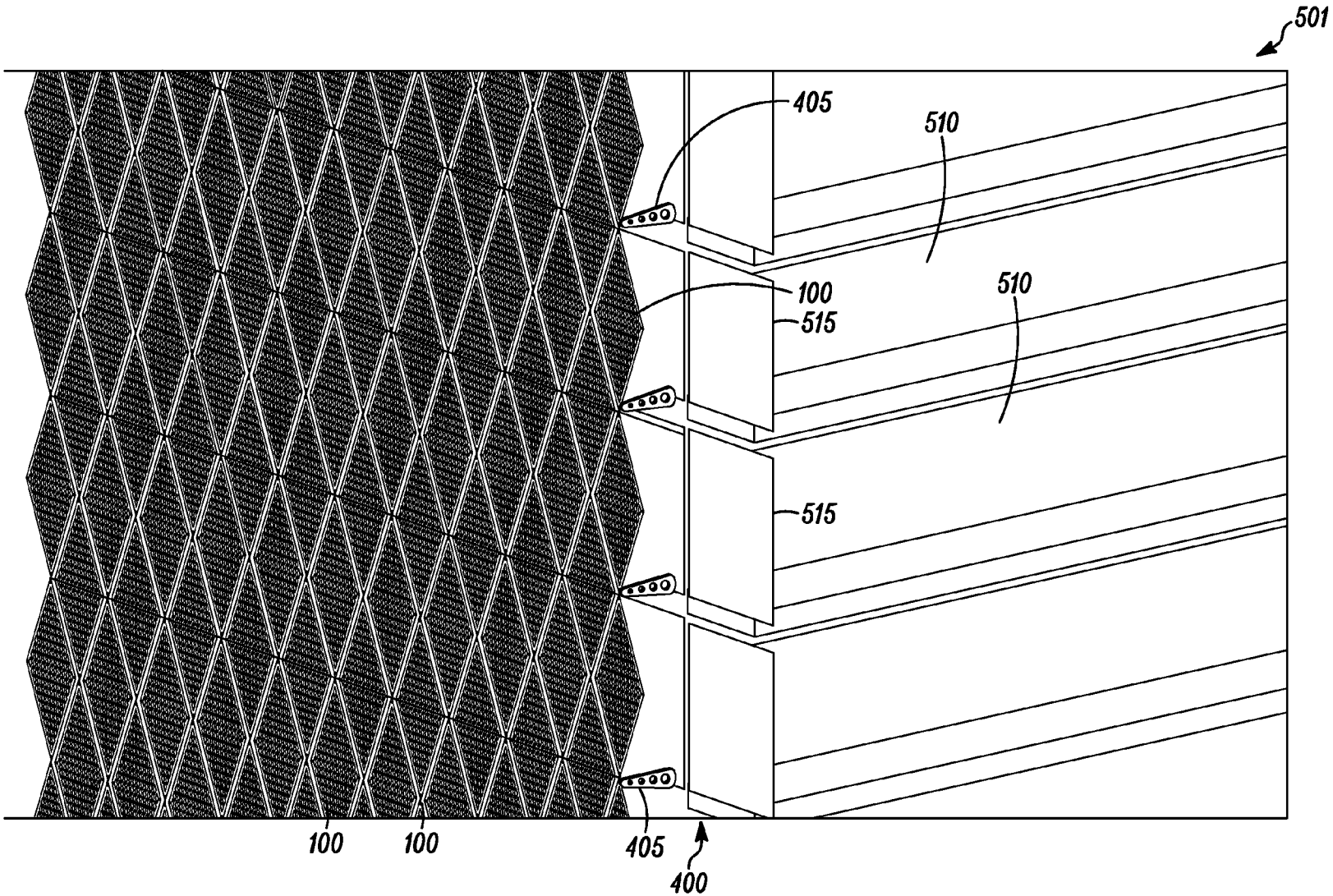
FIG. 5 is view of a system according to an example of the present invention.

FIG. 5 shows a plurality of panels 100 supported by a support system 405 on one side of a building 501. The building 501 is a multi-floor 510 commercial building such as an office building, apartment building, or an industrial building. The building 501 can be a high rise building of the design with interior steel cages that support the weight of the building. Building 501 includes exterior walls 515 that define the interior space on each floor 510. The support system 405 extends outwardly of the exterior wall 515 to support the panels 100 at a position remote from the building's exterior wall 515. A walkway 410 can be positioned in the space between the exterior wall 515 and panels 100. However, a walkway is not required at each floor. The walkway 410 can further be a temporary structure that can be inserted and removed from the support system 405 as needed, for example, if maintenance is required.

The panel system 400 is shown on only one side of the building, nonetheless, it will be recognized that the panel system can extend around the entire building 501, e.g., all sides. It is desired that the panel system face at least the southern direction to reflect light from the exterior of the building. In another example, the panel system may face the direction that severe weather may impact the building 501. The panel system 400 can extend from the ground to the top of the building 501 in one example. In another example, the panel system 400 does not cover each floor, e.g., the first floor or lower floors may not be covered. Due to the modular nature of the panels 100 in the panel system 400, some panels can be left off and others can be partial panels, here, triangle shaped panels so as not to cover entire floors where it is desired to received full sunlight. The panels 100 are aligned with windows on the building 501 as well as solid walls to assist in blocking sunlight and keeping the building cool. In an example, the panels 100 can be removed from the support and reversed and reattached. This may extend the life of any coating on the panels 100. In a further example, different coatings can be applied to the two sides of the panel. The panels can be reversed as desired to change the exterior look of the building or the look of the panel system from inside the building.

Figure 6:
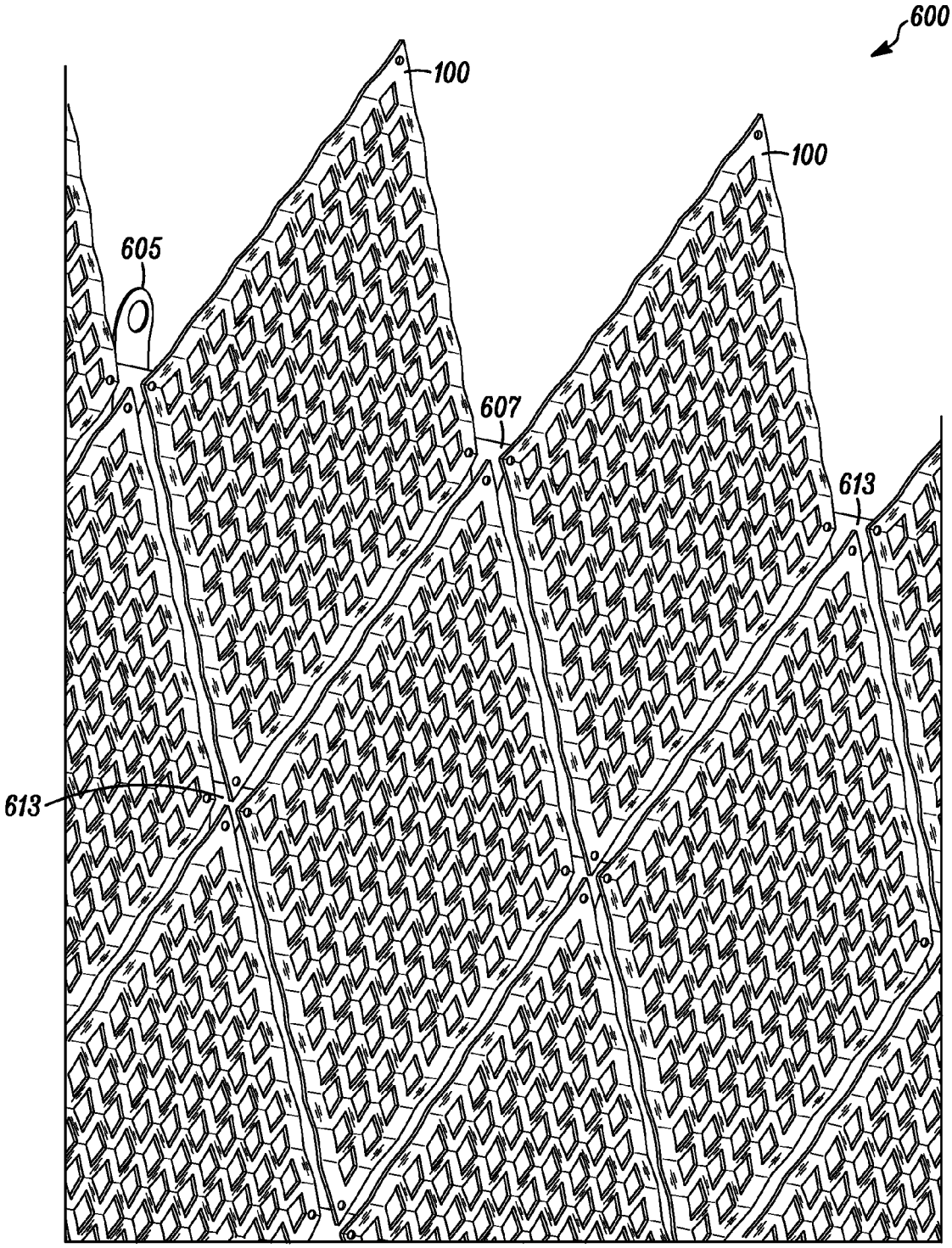
FIG. 6 is view of a building according to an example of the present invention.

FIG. 6 shows a free standing panel system 600 that includes a plurality of panels 100 fixed to a support system 605. The support system 605 is an essentially free standing system that can have some connection points to the building. The support system 605 does not include a walkway, optionally. Support system 605 includes a plurality of metal bars 607 that extend vertically and horizontally to form a frame on which the plates 613 are fixed. The plates 613 can be the same as plates 413 described herein. The panels 100 are fixed to the frame of bars 607, for example, at plates 613. The system 600 can be placed adjacent a location that needs to be shaded or protected as a free standing structure.

The panels systems 400 and 600 are fixed in place, that is the panels remain in place once installed. The individual panels 100 in the systems 400, 600 are not slidable to control the amount of protection provided by the panel system. Accordingly, the amount of protection and strength of panel is calculated before installation and the panels are manufactured accordingly with a certain gauge of metal, size and shape of apertures, number of apertures, and the pitch of the undulations. The panel system 400 or 600 acts to block some sunlight from the building to assist in reducing cooling costs, while at the same time allowing some sunlight through to enhance the environment for the people working in the building and not require the building to be completely lit by artificial lighting.

As shown in FIGS. 4, 5, and 6, the undulation pattern in the panel body 105 undulates in the vertical direction of the panel in its installed state. The peaks and valleys extend in a horizontal line across the entire width of the panel in its installed state.

In a further example, the panels 100 of a system installed on a building are of different dimensions to create different effects and protections to the building. In an example, a plurality of panels 100 has a plurality of heights and widths. In an example, the open areas of different panels (percentage of aperture area as compared to the area of the whole of the panel) are different, e.g., a first group of panels can be solid, i.e., no open area and other groups of panels can have open areas as described herein. Accordingly, it can be said that a first group of panels has a first property and a second group of panels has a second property. The first property is different from the second property. The differing properties can be finishes as well as size of the panels or size of the apertures.

The panel systems as described herein may also be installed inside buildings or around the exterior of the building to divide the interior space for flow control or security. Moreover, the use of the presently described panels can be used to emphasize sunlight in some regions of a building such as an atrium or the entryway. This way be useful in region that lack sunlight whereby the amount of sunlight in a particular interior volume of the building can be increased by reflecting the light in a certain direction utilizing the pattern in the panels.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

I claim:

1. A sunlight blocking component for a building exterior, comprising:

a unitary body of a continuous piece of material and having a height and a width;

a plurality of apertures in the body; and a series of undulations in the body, at least one of the undulations including a peak extending in a width direction, wherein the unitary body includes an outer band and strips that extend within the outer band, wherein the undulations are in the strips and extend into the outer band, the outer band and the strips have a same thickness, the outer band is of the material of the unitary body, and wherein the plurality of apertures and one or more angles of the series of undulations are configured to control an amount of direct sunlight passing through the plurality of apertures to affect an external or interior temperature of a building.

2. The component of claim 1, wherein each of the undulations includes a peak extending in the width dimension and the undulations creating a repeating peak and valley pattern in the vertical direction.

3. The component of claim 1, wherein the plurality of apertures are parallelograms include a corner at a respective one of the peaks of the undulations.

4. The component of claim 3, wherein the plurality of apertures include a corner at respective valley of the undulation.

5. The component of claim 1, wherein the plurality of apertures define an open area in the body in the range of about 40% to about 70%.

6. The component of claim 1, wherein the series of undulations include at least six undulations in a height direction.

7. The component of claim 1, wherein the series of undulations form an angle from a peak to a valley up to an adjacent peak in a range of about 150 degrees to 170 degrees.

8. The component of claim 1, wherein the series of undulations form an angle from a peak to a valley up to an adjacent peak of about 160 degrees.

9. The component of claim 1, wherein the outer band includes a solid outer perimeter free of apertures.

10. The component of claim 1, wherein the body has a parallelogram shape and connection points at at least one of the corners.

11. A building system, comprising:

a wall;

an exterior connection system fixed to the wall; and a panel system connected to the exterior connection system, the panel system including a panel that comprises:

a unitary body of a continuous piece of material and having a height and a width;

a plurality of apertures in the body; and a series of undulations in the body, at least one of the undulations including a peak extending in a width direction, wherein the unitary body includes an outer band and strips that extend within the outer band, wherein the undulations are in the strips and extend into the outer band, wherein outer band and the strips have a same thickness, wherein the outer band is of the material of the unitary body; and wherein the plurality of apertures and one or more angles of the series of undulations are configured to control an amount of direct sunlight passing through the plurality of apertures to affect an external or interior temperature of a building.

12. The building system of claim 11, wherein the panel system comprises a plurality of panels, at least one panel comprising:

the plurality of apertures being parallelograms include a corner at a respective one of the peaks of the undulations;

the plurality of apertures include a corner at respective valley of the undulation;

the plurality of apertures define an open area in the body in the range of about 40% to about 70%; and the series of undulations include at least ten undulations in a vertical direction.

13. The building system of claim 11, wherein series of undulations form an angle from a peak to a valley up to an adjacent peak in a range of about 150 degrees to 170 degrees.

14. The building system of claim 11, wherein the series of undulations form an angle from a peak to a valley up to an adjacent peak of about 160 degrees.

15. The building system of claim 11, wherein the panel system comprises a plurality of panels.

16. A building system, comprising:

a wall;

an exterior connection system fixed to the wall; and a panel system connected to the exterior connection system, the panel system including a panel that comprises:

a body having a height and a width;

a plurality of apertures in the body; and a series of undulations in the body, at least one of the undulations including a peak extending in a width direction, wherein the unitary body includes an outer band and strips that extend within the outer band, wherein the undulations are in the strips and extend into the outer band, wherein outer band and the strips have a same thickness, wherein the outer band is of the material of the unitary body; and wherein the plurality of apertures and one or more angles of the series of undulations are configured to control an amount of direct sunlight passing through the plurality of apertures to affect an external or interior temperature of a building.

17. The building system of claim 11, wherein the exterior connection system comprises a connector having a plus shape with four outwardly extending arms with connection points for a panel at a distal end of each arm.

18. The building system of claim 11, wherein the panel system substantially covers the wall to block a percentage of direct sunlight from the wall.

19. The building system of claim 11, wherein the panel system includes a first group of panels having a first property and a second group of panels having a second property, and wherein the first property is different from the second property.

20. The component of claim 1, wherein the undulations in the unitary body extend the entire width of the body.

21. The component of claim 9, wherein the undulations extend into the solid outer perimeter.

22. The component of claim 1, wherein the apertures have a fixed size.

23. The component of claim 1, wherein the undulations are press-formed in the unitary body.

24. The building system of claim 11, wherein the panel is not slidable such that the amount of solar protection is fixed.

25. The component of claim 1, wherein at least one of the plurality of apertures are on the peak.

26. The component of claim 25, wherein a valley in intermediate two adjacent peaks, and wherein at least one of the plurality of apertures are on the valley.

27. The component of claim 25, wherein at least one of the plurality of apertures extends down from the peak onto an inclined face of the body.

28. The component of claim 27, wherein a valley in intermediate two adjacent peaks, and wherein at least one of the plurality of apertures are on the valley, extends upward onto adjacent faces and ends before the peak peaks at the top of the face.

29. The component of claim 1, wherein the outer band is configured in a polygon with each side being elongate.

30. The component of claim 1, wherein the outer band and the strips have a uniform thickness.

* * * * *